US009511389B2

(12) United States Patent
Teng et al.

(10) Patent No.: US 9,511,389 B2
(45) Date of Patent: Dec. 6, 2016

(54) NOZZLE PLATE STRUCTURE

(71) Applicant: Taiwan Puritic Corp., Hukou Township, Hsinchu County (TW)

(72) Inventors: Huan-Ping Teng, Hukou Township, Hsinchu County (TW); Chih-Hsiang Hsu, Hukou Township, Hsinchu County (TW)

(73) Assignee: Taiwan Puritic Corp., Hukuo Township, Hsinchu County (TW)

( * ) Notice: Subject to any disclaimer, the term of this patent is extended or adjusted under 35 U.S.C. 154(b) by 266 days.

(21) Appl. No.: 14/267,467

(22) Filed: May 1, 2014

(65) Prior Publication Data

US 2015/0209806 A1 Jul. 30, 2015

(30) Foreign Application Priority Data

Jan. 28, 2014 (TW) ..... 103201794 U

(51) Int. Cl.

| | |
|---|---|
| ***B05B 1/00*** | (2006.01) |
| ***B05B 17/00*** | (2006.01) |
| ***B05B 1/14*** | (2006.01) |
| ***B05B 1/28*** | (2006.01) |
| ***B05B 15/02*** | (2006.01) |
| ***F02M 61/18*** | (2006.01) |
| ***B05B 1/02*** | (2006.01) |

(52) U.S. Cl.

CPC ..... *B05B 17/0646* (2013.01); *B05B 1/02* (2013.01); *B05B 1/14* (2013.01); *B05B 1/28* (2013.01); *B05B 15/02* (2013.01); *F02M 61/1806* (2013.01); *F02M 61/1853* (2013.01)

(58) Field of Classification Search

CPC ..... B05B 17/0646; B05B 15/02; B05B 1/28; B05B 1/14; B05B 1/02; F02M 61/1806; F02M 61/1853

USPC ..... 239/104, 499, 533.12, 548, 552, 596, 239/601

See application file for complete search history.

(56) References Cited

U.S. PATENT DOCUMENTS

| | | | | |
|---|---|---|---|---|
| 5,899,390 | A * | 5/1999 | Arndt | B05B 1/34 239/533.12 |
| 7,185,831 | B2 * | 3/2007 | Goenka | F02M 61/1806 239/596 |
| 7,438,241 | B2 * | 10/2008 | Goenka | F02M 61/1853 239/601 |

* cited by examiner

*Primary Examiner* — Steven J Ganey

(74) *Attorney, Agent, or Firm* — Muncy, Geissler, Olds & Lowe, P.C.

(57) ABSTRACT

The present invention relates to a nozzle plate structure which comprises a plate and a plurality of orifices penetrating the plate. Each orifice comprises a liquid-storing space and a liquid-outputting space. Through the configuration of the liquid-storing space, the liquid in a container can be smoothly educed therefrom. Through the configuration of the liquid-outputting space, liquid dripping can be decreased. Alternatively, a liquid-guiding space is arranged between the liquid-storing space and the liquid-outputting space, so that the resonance oscillation of the liquid in the orifice can be enhanced. Further, the remaining liquid in the liquid-outputting space can be reabsorbed by the capillarity of the liquid-guiding space.

7 Claims, 4 Drawing Sheets

NOZZLE PLATE STRUCTURE

BACKGROUND OF THE INVENTION

1. Field of the Invention

The present invention relates to a nozzle plate structure, particularly to a micro nozzle plate fabricated by electroforming and applied to liquid atomization devices, such as a semiconductor photoresist coating machine, a medication device, and an aromatic essential oil diffuser. Each orifice of the nozzle plate of the present invention has a structure with different layers/sections/parts/spaces so as to enhance the effect of liquid atomization.

2. Description of the Prior Art

Nozzle plates are commonly used in liquid atomization devices, such as semiconductor photoresist coating machines, medication devices, aromatic essential oil diffusers, sprayers, ink cartridges and the like. A nozzle plate uses the principle of electronic oscillation to generate high frequency vibrations to scatter a bigger molecular cluster of liquid into several smaller molecular clusters in a conditions adapted to be atomized or sprayed.

However, the nozzle plate structures of the current atomization devices are usually too simple to atomize liquid completely. For example, the orifice thereof is merely a circular through-hole. In such a case, liquid are likely to accumulate around the orifices, and liquid droplets are likely to drip down therefrom. Thus, the effect of atomization or the quality of spray-dispersing is degraded.

The present invention intends to provide a nozzle plate structure to solve the problem of droplet dripping and improve the effect and quality of liquid atomization.

SUMMARY OF THE INVENTION

In one embodiment, the present invention relates to a nozzle plate structure, which comprises a plate and a plurality of orifices penetrating the plate, wherein each orifice includes a liquid-storing space, a liquid-guiding space and a liquid-outputting space. The liquid-storing space is defined by a liquid-storing wall of the plate. The liquid-storing space has a first liquid-storing opening and a second liquid-storing opening opposite to the first liquid-storing opening. The liquid-storing wall has an arc-shaped surface. The liquid-guiding space is defined by a liquid-guiding wall of the plate. The liquid-guiding space connects and communicates with the liquid-storing space via the second liquid-storing opening. The liquid-guiding wall is smoothly connected with the liquid-storing wall. The liquid-outputting space is defined by a first liquid-outputting wall and a second liquid-outputting wall of the plate and connects and communicates with the liquid-guiding space. The first liquid-outputting wall is connected with the liquid-guiding wall. The second liquid-outputting wall is connected with the first liquid-outputting wall in a nonparallel way.

In another embodiment, the present invention relates to a nozzle plate structure, which comprises a plate and a plurality of orifices penetrating the plate, wherein each orifice includes a liquid-storing space and a liquid-outputting space. The liquid-storing space is defined by a liquid-storing wall of the plate. The liquid-storing space has a first liquid-storing opening and a second liquid-storing opening opposite to the first liquid-storing opening. The liquid-storing wall has an arc-shaped surface. The liquid-outputting space connects and communicates with the liquid-storing space via the second liquid-storing opening. The liquid-outputting space is defined by a first liquid-outputting wall and a second liquid-outputting wall of the plate. The first liquid-outputting wall is connected with the liquid-storing wall. The second liquid-outputting wall is connected with the first liquid-outputting wall in a nonparallel way.

The objective, technologies, features and advantages of the present invention will become apparent from the following description in conjunction with the accompanying drawings wherein certain embodiments of the present invention are set forth by way of illustration and example.

BRIEF DESCRIPTION OF THE DRAWINGS

The foregoing conceptions and their accompanying advantages of this invention will become more readily appreciated after being better understood by referring to the following detailed description, in conjunction with the accompanying drawings, wherein.

DESCRIPTION OF THE PREFERRED EMBODIMENT

The detailed explanation of the present invention is described as follows. The described preferred embodiments and examples are presented for purposes of illustrations and description, and they are not intended to limit the scope of the present invention.

Figure 1:
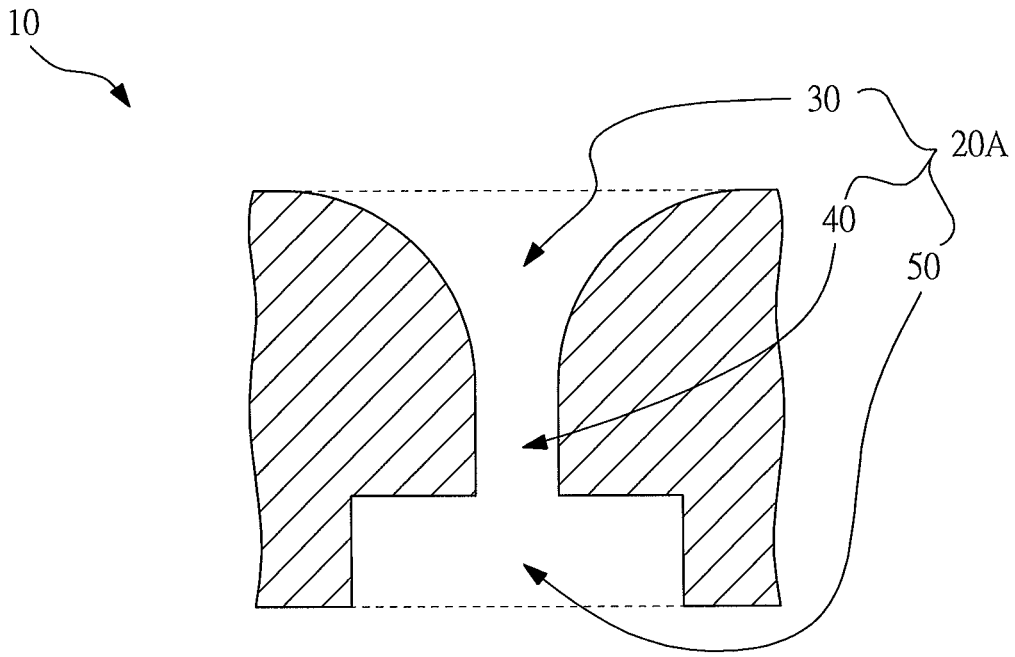
FIG. 1 is a sectional view schematically showing an orifice of a nozzle plate structure according to one embodiment of the present invention.

FIG. 1 shows a sectional view of an orifice 20A of a nozzle plate structure according to one embodiment of the present invention. The nozzle plate structure comprises a plate 10 and a plurality of orifices 20A penetrating through the plate 10. The orifice 20A includes a liquid-storing space 30, a liquid-guiding space 40 and a liquid-outputting space 50.

Figure 2:
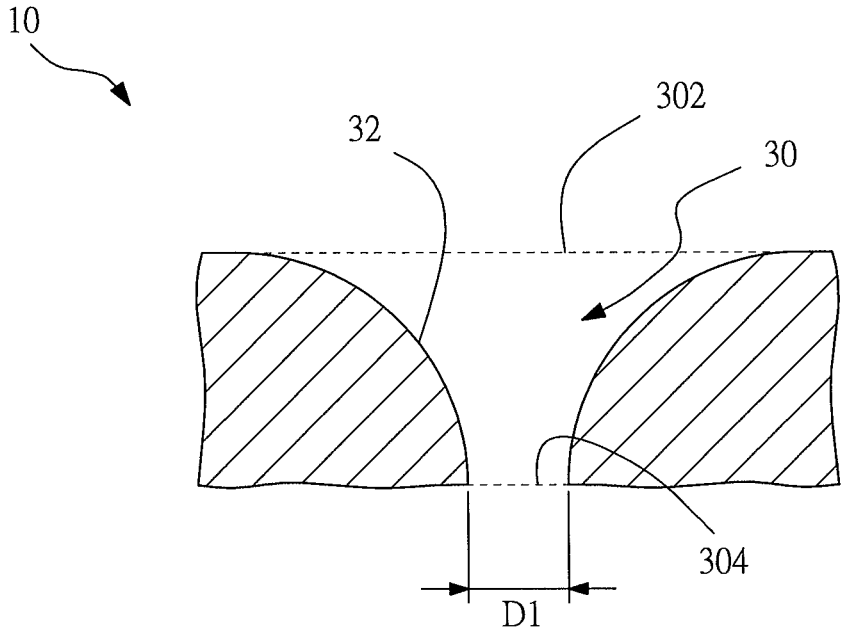
FIG. 2 is a sectional view schematically showing a liquid-storing space of an orifice according to one embodiment of the present invention.

FIG. 2 is a sectional view schematically showing the liquid-storing space 30 of the orifice 20A according to one embodiment of the present invention. The liquid-storing space 30, configured to be a part/space of the orifice 20A, initially contacting with the liquid inside a container (not shown). In other words, the liquid-storing space 30 is configured to face the interior of a container. The liquid-storing space 30 is defined by a liquid-storing wall 32 of the plate 10. The liquid-storing space 30 has a first liquid-storing opening 302 and a second liquid-storing opening 304 opposite to the first liquid-storing opening 302. Preferably, the liquid-storing wall 32 has an arc-shaped surface. Preferably, the first liquid-storing opening 302 has a width, and the second liquid-storing opening 304 has a width D1 smaller than the width of the first liquid-storing opening 302. In a preferred embodiment, the liquid-storing wall 32 has an arc-shaped surface; the width of the first liquid-storing opening 302 is greater than the width D1 of the second liquid-storing opening 304. Preferably, the width D1 of the second liquid-storing opening 304 ranges from 3 to 45 μm. Owing to that the liquid-storing wall 32 has an arc-shaped surface and that the width of the first liquid-storing opening 302 is greater than the width D1 of the second liquid-storing opening 304, the liquid in a container can easily enter the liquid-storing space 30 via the wider first liquid-storing opening 302, and then the arc-shaped surface of the liquid-storing wall 32 smoothly guides the liquid to go out from the narrower second liquid-storing opening 304. Such a structure favors liquid atomization or tiny-droplet formation.

Figure 3:
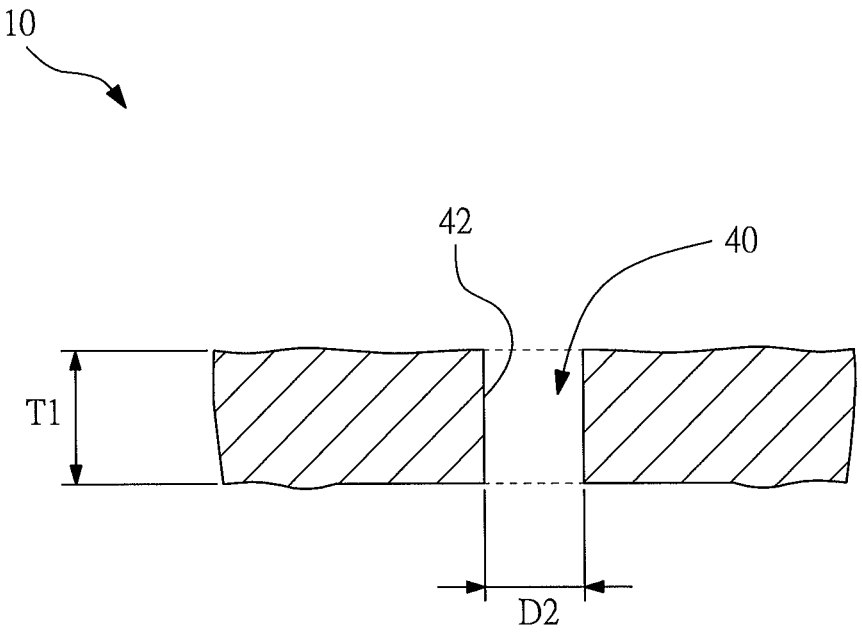
FIG. 3 is a sectional view schematically showing a liquid-guiding space of an orifice according to one embodiment of the present invention.

FIG. 3 is a sectional view schematically showing a liquid-guiding space 40 of an orifice 20A according to one embodiment of the present invention. As shown in FIG. 1, the liquid-guiding space 40 connects and communicates with the liquid-storing space 30 and the liquid-outputting space 50 so as to guide liquid to flow from the liquid-storing space 30 to the liquid-outputting space 50. The liquid-guiding space 40 is defined by a liquid-guiding wall 42 of the plate 10 and has a width D2. The liquid-guiding space 40 connects and communicates with the liquid-storing space 30 via the second liquid-storing opening 304. The liquid-guiding wall 42 is smoothly connected with the liquid-storing wall 32. Preferably, the width D2 of the liquid-guiding space 40 ranges from 3 to 45 μm. Preferably, the width D2 of the liquid-guiding space 40 is generally equal to the width D1 of the second liquid-storing opening 304. Wherein, under such configuration and arrangement of the liquid-guiding space 40, the liquid-guiding space 40 can generate the capillary effect so as to favor the liquid in a container flowing out from the liquid-storing space 30. Further, the liquid-guiding space 40 can also enhance the resonance of the liquid in the liquid-guiding space 40 and improve the effect of atomization. Furthermore, the size of droplets can be controlled via adjusting the width D2 of the liquid-guiding space 40. Preferably, the liquid-guiding space 40 has a height T1 ranging from 0.01 to 35 μm.

Figure 4:
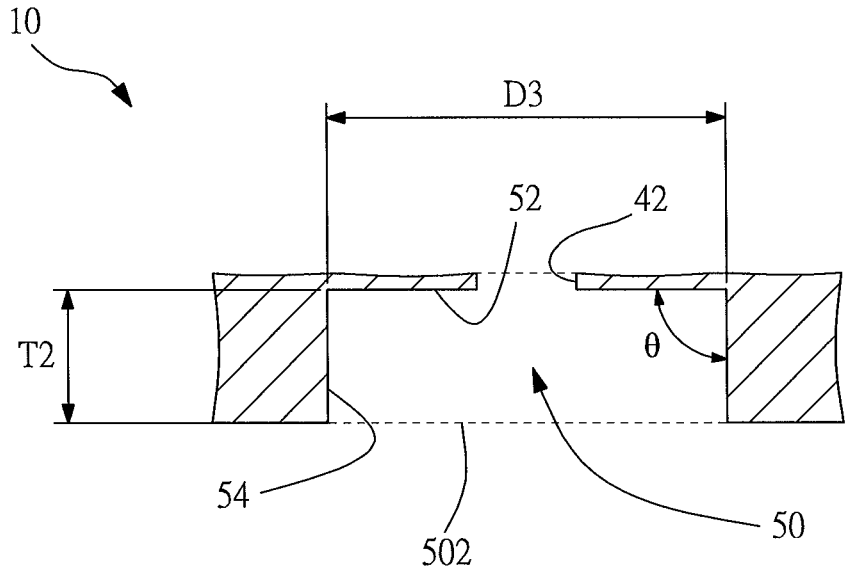
FIG. 4 is a sectional view schematically showing a liquid-outputting space of an orifice according to one embodiment of the present invention.

FIG. 4 is a sectional view schematically showing a liquid-outputting space 50 of an orifice 20A according to one embodiment of the present invention. As shown in FIG. 1, the liquid-outputting space 50 is arranged in a region corresponding to the liquid-storing space 30 and connected with the liquid-guiding space 40 so as to output the atomized liquid inside a container to the exterior of the container. The liquid-outputting space 50 is defined by a first liquid-outputting wall 52 and a second liquid-outputting wall 54 of the plate 10. The liquid-outputting space 50 connects and communicates with the liquid-guiding space 40. The first liquid-outputting wall 52 is connected with the liquid-guiding wall 42. The second liquid-outputting wall 54 is connected with the first liquid-outputting wall 52 in a nonparallel way. A liquid-outputting opening 502 is defined by an end of the second liquid-outputting wall 54 away from the first liquid-outputting wall 52. Preferably, the first liquid-outputting wall 52 is connected with the second liquid-outputting wall 54 by an included angle θ within the liquid-outputting space 50. Preferably, the liquid-outputting space 50 has a height T2 ranging from 0.01 to 25 μm. The junction of the first liquid-outputting wall 52 and the second liquid-outputting wall 54 defines a width D3 of the liquid-outputting space 50. Preferably, the width D3 ranges from 15 to 80 μm. Wherein, under such configuration and arrangement of the liquid-outputting space 50, the liquid-outputting space 50 can accumulate and accommodate the atomized liquid that does not effuse/spray out. Based on the communication between the liquid-outputting space 50 and the liquid-guiding space 40, the liquid accumulated within the liquid-outputting space 50 is reabsorbed into the liquid-guiding space 40 or the liquid-storing space 30 by the capillary effect of the liquid-guiding space 40. Thereby, liquid-outputting space 50 can hold the accumulated liquid and prevent the accumulated liquid from dripping down.

Figure 5A:
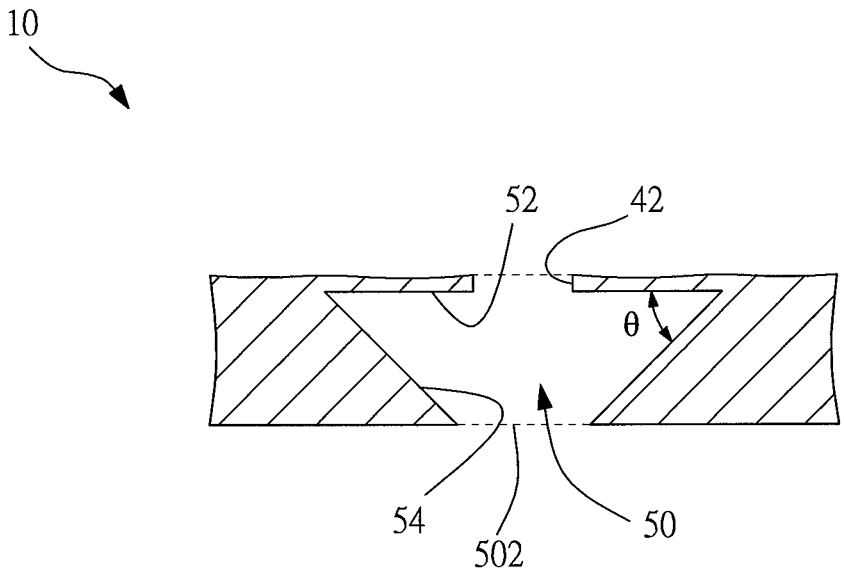
FIG. 5A and FIG. 5B are sectional views schematically showing liquid-outputting spaces respectively having different included angles according to different examples of the present invention.
Figure 5B:
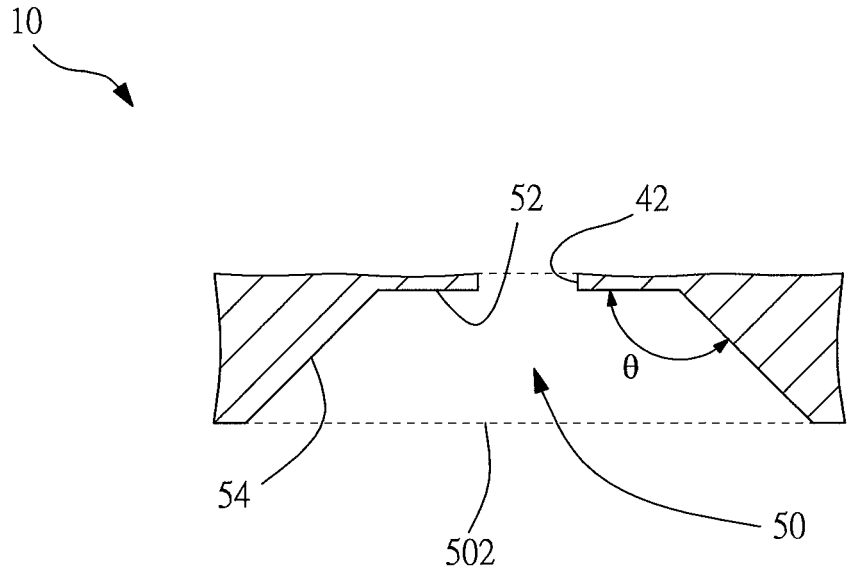

Preferably, as the examples shown in FIGS. 5A-5B, the included angle θ between the first liquid-outputting wall 52 and the second liquid-outputting wall 54 is a specified angle. That is to say, the included angle θ is a fixed angle. Wherein, the included angle θ ranges from 45 to 165 degrees, so that the second liquid-outputting wall 54 is symmetrically arranged in the cross section thereof. In FIG. 5A, the included angle θ is an acute one, and the liquid-outputting space 50 has a liquid-outputting opening 502 narrower than that in FIG. 4, whereby the spray of the atomized liquid generated by the nozzle plate of the this example is more convergent, and whereby the liquid-holding effect of the liquid-outputting space 50 is further enhanced. In FIG. 5B, the included angle θ is an obtuse one, and the liquid-outputting space 50 has a liquid-outputting opening 502 wider than that in FIG. 4, whereby the spray of the atomized liquid generated by the nozzle plate of this example is more divergent, and whereby the liquid-holding effect of the liquid-outputting space 50 is also enhanced. Further, the volume of the liquid-outputting space 50 is increased to accommodate more liquid, so that the nozzle plate structure this example can effectively decrease liquid dripping during a long cycle of spraying. Optionally, in an alternative example, the included angle θ between the first liquid-outputting wall 52 and the second liquid-outputting wall 54 is not a specified angle. That is to say, the included angle θ is a variable angle. Wherein, the included angle θ ranges from 45 to 165 degrees, so that the second liquid-outputting wall 54 is asymmetrically arranged in the cross section thereof (not shown), whereby the nozzle plate structure of the alternative example can also decrease liquid dripping and spray the atomized liquid to a specified direction.

Figure 6:
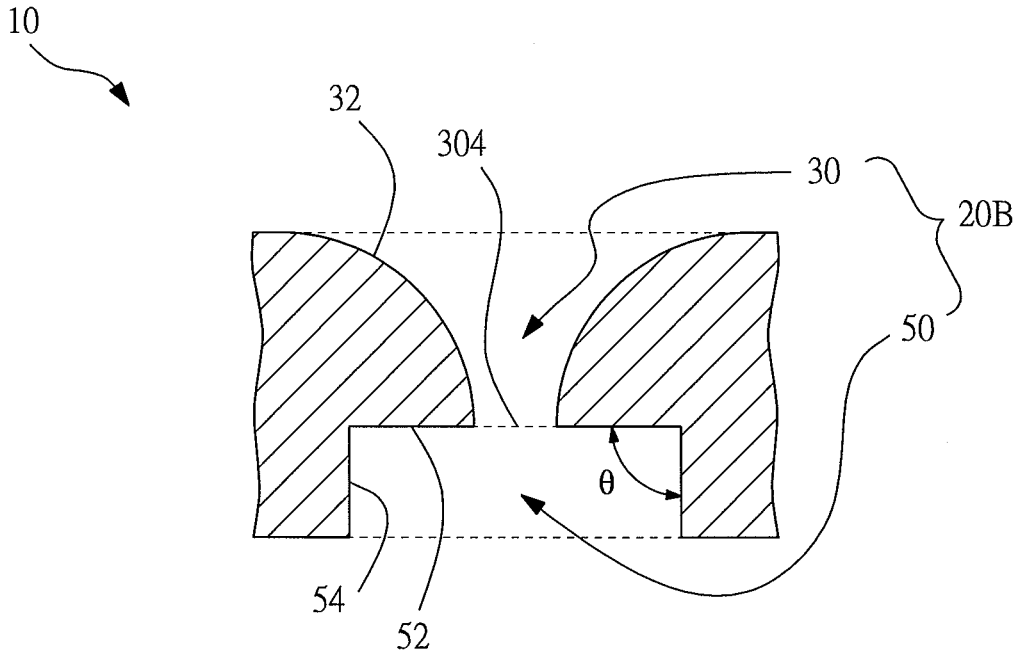
FIG. 6 is a sectional view schematically showing an orifice of a nozzle plate structure according to another embodiment of the present invention.

FIG. 6 is a sectional view of a nozzle plate structure according to another embodiment of the present invention and schematically shows the structure of an orifice 20B in a plate 10. The orifice 20B includes a liquid-storing space 30 and a liquid-outputting space 50. In this embodiment, the liquid-outputting space 50 connects and communicates with the liquid-storing space 30, and the first liquid-outputting wall 32 is connected with the liquid-storing wall 32. More specifically, the liquid-outputting space 50 is connects and communicates with the liquid-storing space 30 via the second liquid-storing opening 304. Wherein, the second liquid-storing opening 304 of the liquid-storing space 30 is configured to generate the capillary effect so as to guide the liquid of a container from the liquid-storing space 30 to the liquid-outputting space 50 and reabsorb the residual liquid back to the liquid-storing space 30. The other structures and characteristics of this embodiment are similar to those of the abovementioned embodiments and examples, and hence will not repeat herein.

It should be noted that in the present invention, the value of each of the width D1 of the second liquid-storing opening 304, the width D2 of the liquid-guiding space 40, the width D3 of the liquid-outputting space 50, the height T1 of the liquid-guiding space 40 and the height T2 of the liquid-outputting space 50 can be adjusted by an increment or decrement of 0.01 μm. For example, the height T1 of the liquid-guiding space 40 may have a value of 0.01 μm, 0.02

μm, 0.03 μm . . . 34.99 μm or 35 μm. In other words, the heights T1 of the liquid-guiding space 40 are distributed in a range from 0.01 μm to 35 μm in form of an arithmetic sequence with a common difference of 0.01 μm. Similarly, the value of the included angle θ between the first liquid-outputting wall 52 and the second liquid-outputting wall 54 can be adjusted by an increment or decrement of 0.01 degrees.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A nozzle plate structure comprising:

a plate; and a plurality of orifices penetrating said plate and each including:

a liquid-storing space defined by a liquid-storing wall of said plate and having a first liquid-storing opening and a second liquid-storing opening opposite to said first liquid-storing opening, said liquid-storing wall having an arc-shaped surface;

a liquid-guiding space defined by a liquid-guiding wall of said plate, said liquid-guiding space connecting and communicating with said liquid-storing space via said second liquid-storing opening, said liquid-guiding wall smoothly connected with said liquid-storing wall; and a liquid-outputting space defined by a first liquid-outputting wall and a second liquid-outputting wall of said plate, said liquid-outputting space connecting and communicating with said liquid-guiding space, said first liquid-outputting wall connecting with said liquid-guiding wall, and said second liquid-outputting wall connecting with said first liquid-outputting wall in a nonparallel way;

wherein said liquid-outputting space has a height ranging from 0.01 to 25 μm, a width of said liquid-outputting space is defined by a junction of said first liquid-outputting wall and said second liquid-outputting wall and ranges from 15 to 80 μm; and wherein a width of said first liquid-storing opening is greater than a width of said second liquid-storing opening, said width of said second liquid-storing opening ranges from 3 to 45 μm, and said width of said liquid-outputting space is greater than said width of said second liquid-storing opening.

2. The nozzle plate structure according to claim 1, wherein said liquid-guiding space has a width and a height, said width of said liquid-guiding space is identical to said width of said second liquid-storing opening, and said height of said liquid-guiding space ranges from 0.01 to 35 μm.

3. The nozzle plate structure according to claim 1, wherein said first liquid-outputting wall is connected with said second liquid-outputting wall by an included angle within said liquid-outputting space, said included angle is a specified angle within 45-165 degrees, so that said second liquid-outputting wall is symmetrically arranged in a cross section thereof.

4. The nozzle plate structure according to claim 1, wherein said first liquid-outputting wall is connected with said second liquid-outputting wall by an included angle within said liquid-outputting space, said included angles is a variable angle ranging from 45 to 165 degrees, so that said second liquid-outputting wall is asymmetrically arranged in a cross section thereof.

5. A nozzle plate structure comprising:

a plate; and a plurality of orifices penetrating said plate and each including:

a liquid-storing space defined by a liquid-storing wall of said plate and having a first liquid-storing opening and a second liquid-storing opening opposite to said first liquid-storing opening, said liquid-storing wall having an arc-shaped surface; and a liquid-outputting space connecting and communicating with said liquid-storing space via said second liquid-storing opening, said liquid-outputting space defined by a first liquid-outputting wall and a second liquid-outputting wall of said plate, said first liquid-outputting wall connecting with said liquid-storing wall, and said second liquid-outputting wall connecting with said first liquid-outputting wall in a non-parallel way;

wherein said liquid-outputting space has a height ranging from 0.01 to 25 μm, a width of said liquid-outputting space is defined by a junction of said first liquid-outputting wall and said second liquid-outputting wall and ranges from 15 to 80 μm; and wherein a width of said first liquid-storing opening is greater than a width of said second liquid-storing opening, said width of said second liquid-storing opening ranges from 3 to 45 μm, and said width of said liquid-outputting space is greater than said width of said second liquid-storing opening.

6. The nozzle plate structure according to claim 5, wherein said first liquid-outputting wall is connected with said second liquid-outputting wall by an included angle within said liquid-outputting space, said included angle is a specified angle within 45-165 degrees, so that said second liquid-outputting wall is symmetrically arranged in a cross section thereof.

7. The nozzle plate structure according to claim 5, wherein said first liquid-outputting wall is connected with said second liquid-outputting wall by an included angle within said liquid-outputting space, said included angle is a variable angle ranging from 45 to 165 degrees, so that said second liquid-outputting wall is asymmetrically arranged in a cross section thereof.

* * * * *